US008973467B2

(12) United States Patent
Bronee

(10) Patent No.: US 8,973,467 B2
(45) Date of Patent: Mar. 10, 2015

(54) FRAMING AND FORMING HAMMER

(71) Applicant: Les Bronee, Cobble Hill (CA)

(72) Inventor: Les Bronee, Cobble Hill (CA)

( * ) Notice: Subject to any disclaimer, the term of this patent is extended or adjusted under 35 U.S.C. 154(b) by 197 days.

(21) Appl. No.: 13/677,064

(22) Filed: Nov. 14, 2012

(65) Prior Publication Data

US 2014/0053342 A1 Feb. 27, 2014

Related U.S. Application Data

(60) Provisional application No. 61/560,662, filed on Nov. 16, 2011.

(51) Int. Cl.

| | |
|---|---|
| ***B25D 1/04*** | (2006.01) |
| ***B25D 1/02*** | (2006.01) |
| ***B25D 1/12*** | (2006.01) |
| ***B25D 1/14*** | (2006.01) |

(52) U.S. Cl.

CPC .. *B25D 1/04* (2013.01); *B25D 1/14* (2013.01); *B25D 1/02* (2013.01); *B25D 1/12* (2013.01); *B25D 2222/57* (2013.01)

USPC ..... 81/26; 81/22; 7/143; 7/166

(58) Field of Classification Search

USPC ..... 81/26, 22, 23; 7/143, 146, 147, 166

See application file for complete search history.

(56) References Cited

U.S. PATENT DOCUMENTS

| | | | | | |
|---|---|---|---|---|---|
| 468,191 | A * | 2/1892 | Chambers | 81/26 |
| 834,827 | A * | 10/1906 | Luse | 81/19 |
| 1,383,452 | A * | 7/1921 | Dickinson | 81/19 |
| 1,542,748 | A * | 6/1925 | Walter | 81/26 |
| 1,664,594 | A * | 4/1928 | Cummings | 7/143 |
| 1,737,647 | A * | 12/1929 | Cummings | 81/26 |
| 2,884,969 | A * | 5/1959 | Lay | 81/22 |
| 3,796,244 | A * | 3/1974 | Florian | 81/26 |
| 4,910,820 | A * | 3/1990 | Brinkman | 7/138 |
| 5,159,858 | A * | 11/1992 | Gansen | 81/23 |
| 5,590,868 | A * | 1/1997 | Hebert et al. | 254/26 R |
| 5,894,764 | A * | 4/1999 | Hanlon | 81/23 |
| 5,911,795 | A * | 6/1999 | Tucker | 81/22 |
| 6,301,996 | B1 * | 10/2001 | Crawford | 81/24 |
| 6,397,420 | B1 * | 6/2002 | Roxton | 7/145 |
| 6,598,858 | B2 * | 7/2003 | Santa Cruz et al. | 254/26 R |
| 6,619,408 | B1 * | 9/2003 | Lai | 173/90 |
| 6,772,657 | B2 * | 8/2004 | Nakayama | 81/23 |
| 6,829,966 | B1 * | 12/2004 | Bramuchi | 81/26 |
| 7,350,440 | B2 * | 4/2008 | Casolco | 81/20 |
| 8,585,016 | B2 * | 11/2013 | Woolley et al. | 254/26 R |
| 2006/0048608 | A1 * | 3/2006 | Santa Ana | 81/23 |
| 2008/0053278 | A1 * | 3/2008 | St. John et al. | 81/20 |
| 2011/0113566 | A1 * | 5/2011 | Holbrook | 7/146 |

* cited by examiner

*Primary Examiner* — David B Thomas

(74) *Attorney, Agent, or Firm* — Davis & Bujold, PLLC; Michael J. Bujold

(57) ABSTRACT

A forming and framing hammer comprises an elongate handle and a head fixed to the top end of the handle. The head has three striking surfaces: two on a striking body and one on the side of the head. The third striking surface is cushioned by a neoprene bushing to reduce vibration in the handle of the hammer. The head has two pulling tools for pulling nails. The bottom of the handle accepts interchangeable tools.

12 Claims, 3 Drawing Sheets

FRAMING AND FORMING HAMMER

CROSS-REFERENCE TO RELATED APPLICATIONS

This application claims the benefit of U.S. provisional patent application No. 61/560,662 filed in the USPTO on Nov. 16, 2011 and incorporated herein by reference.

BACKGROUND OF THE INVENTION

1. Field of the Invention

This invention relates to tool driving and impacting devices and specifically for a hand-held forming/framing hammer.

2. Background

Hammers are well known in the construction and framing trades. They have been used by skilled and un-skilled works for centuries and they continue to evolve. One aspect of a modern hammer is that it must be able to be used in a back-to-front striking motion as well as a side-to-side striking motion. Hammers must also be able to be used to hit a target object perpendicularly as well as at an oblique angle.

SUMMARY OF THE INVENTION

The present invention contains a number of improvements over a conventional hammer in that it incorporates the requirements noted above.

The hammer has three striking surfaces on the hammer head. The first two striking surfaces are on the front face of a striking body. The first striking surface is perpendicular to a horizontal axis and the second striking surface depends from the first striking surface and is angled back at a predetermined angle. The third striking surface is on the side of the hammer head. The third striking surface includes a vibration dampening cushion between it and the hammer head.

The handle comprises a spine of steel covered in vibration absorbing material such as wood. The bottom of the spine can accept a variety of tools in a pivoting relationship. The top of the spine is fixed to the head of the hammer.

BRIEF DISCRIPTION OF THE FIGURES

DESCRIPTION OF THE INVENTION

Figure 1:
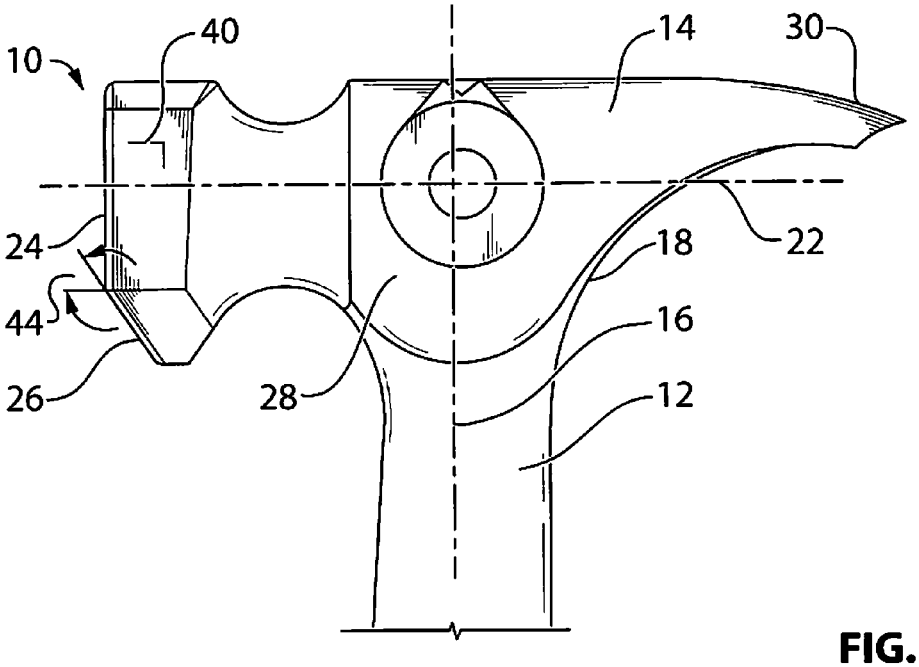
FIG. 1 is a side view of the head of the hammer.

Referring now to the Figures and in particular FIG. 1, my invention is a hammer 10 comprising an elongate handle 12 and a head 14. The handle 12 defines a first vertical axis 16, a first end 18 and a second end. The hammer head 14 is fixed to the first end 18 of the handle 16. The hammer head 14 has a second horizontal axis 22 that is perpendicular to the first axis 16. The hammer head includes a first 24, a second 26 and a third 28 striking faces. The hammer of the present invention includes at least one object pulling tool 30 integral to the hammer head.

Figure 2:
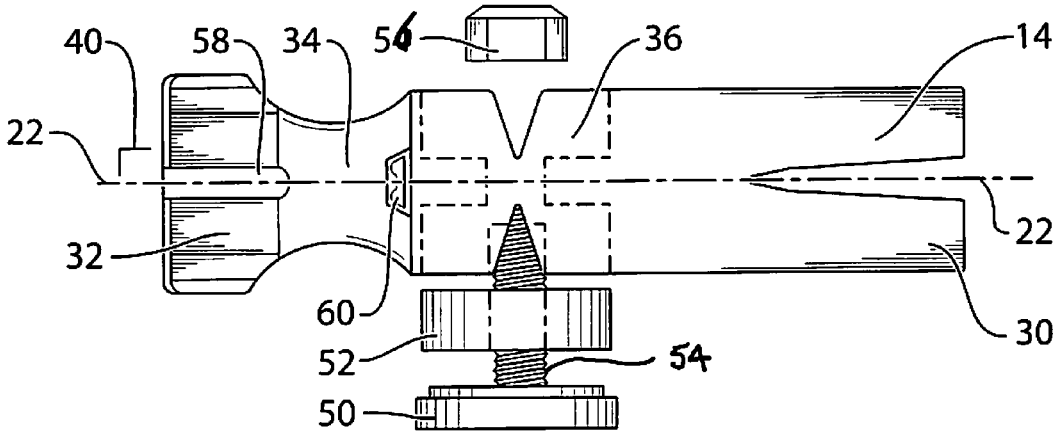
FIG. 2 is a top view of the head of the hammer.

Referring now to FIG. 2, the hammer head comprises a striker body 32 fixed to a neck 34 extending axially forwardly along the second axis 22. The hammer head further comprises a first object pulling tool 30 extending rearward and generally parallel to the second axis 22. The hammer head 14 further comprises an aperture 36 for receiving the elongate handle first end 18.

Referring to FIG. 1 and FIG. 2, the striker body 32 comprises a first striker face 24 at the distal end thereof and perpendicular 40 to the second axis 22. A second striker face 26 depends rearward from the first striker 38 face at a predetermined angle 44.

Figure 3:
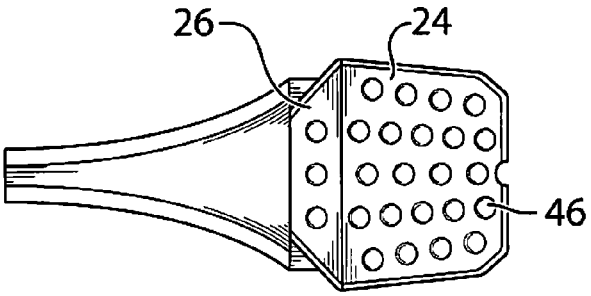
FIG. 3 is a bottom view of the striking body and the first and second striking face of the hammer.
Figure 4A:
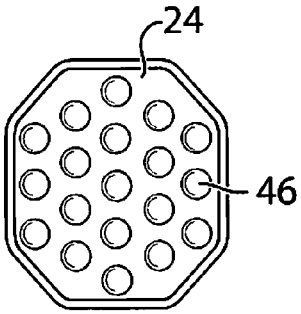
FIG. 4A is a front view of the first and second striking faces of the striking body of the hammer.
Figure 4B:
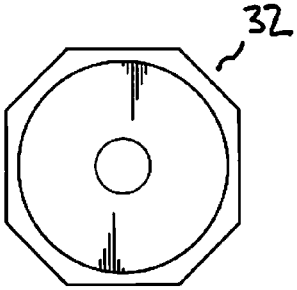
FIG. 4B is a rear view of the striking body of the hammer.

Referring now to FIGS. 3 and 4A the first striker face 24 and the second striker face 26 comprise a plurality of spaced hemi-spherical pits 46. These increase traction of the striking surface on the work piece such as a nail head. FIG. 4B illustrates a rear view of the striking body 32 of the hammer.

Referring to FIGS. 1 and 2, there is a third striking face 28 that is disposed on at least one side of the head 14 over the first vertical axis 16. In the embodiment shown the third striking face 28 is on the surface of a circular disc-shaped body 50. Between the body 50 and head 14 there is disposed a circular spacer disc 52 of shock absorbing material. In one embodiment of the invention the shock absorbing material is neoprene. The third striking face body 50 is attached to the head 14 by a screw 54 fixed to the body 50 and hex nut 56.

The striker body 32 further comprises a nail alignment device comprising a nail alignment slot 58 in the striker body 32 and a nail head recess 60 disposed in the neck 34 for receiving a nail head.

Figure 5:
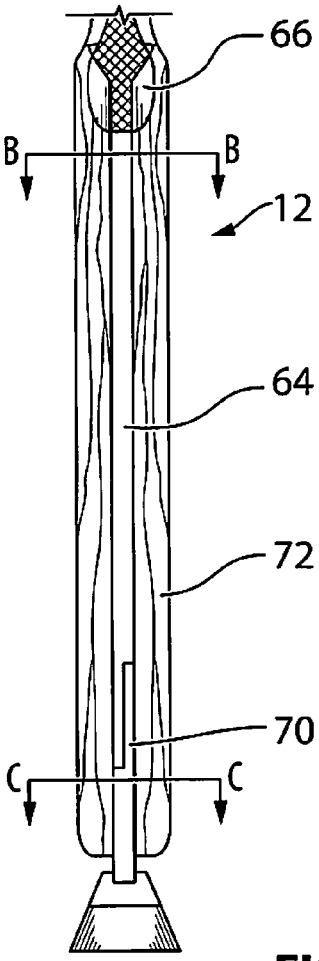
FIG. 5 is a front view of the handle of the hammer.

Referring now to FIG. 5, the elongate handle 12 comprises a spine 64 defining a first end 66 and a second end 70. The spine first end 66 is fixed to the head 12. The spine 64 is overlain by shock absorbing material 72 such as wood.

Figure 6:
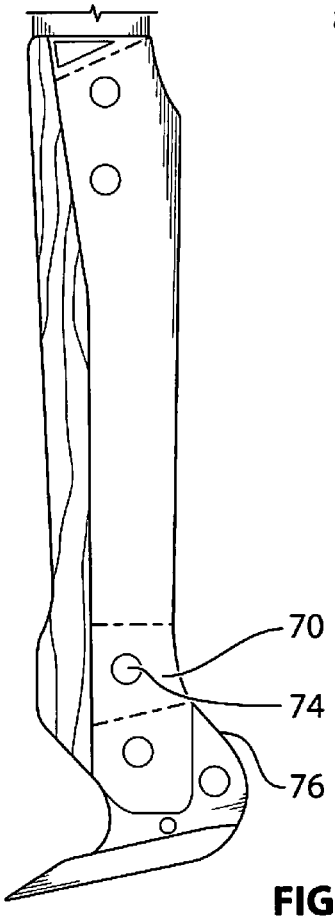
FIG. 6 is a side view of the handle of the hammer.

Referring to FIG. 6, the spine second end 70 is apertured 74 to accept a tool 76 such as a second object pulling tool in a pivoting relationship.

Figure 7:
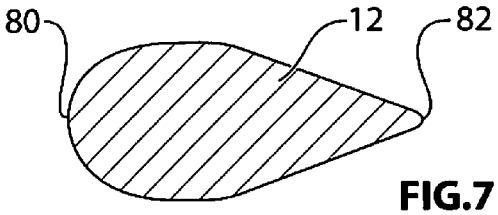
FIG. 7 is a cross-sectional view of the handle of the hammer at B-B in FIG. 5.

Referring to FIG. 7, there is shown in cross-section the handle at B-B in FIG. 5. The handle 12 has a forward end 80 that is curved and a rearward end 82 that is sharp for scraping and splitting a work piece.

Figure 8:
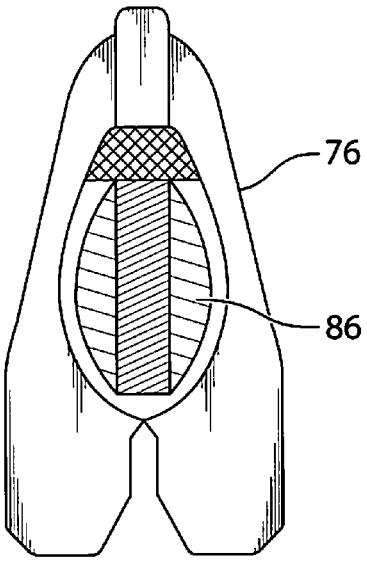
FIG. 8 is a cross-sectional view of the handle of the hammer at C-C in FIG. 5.

Referring now to FIG. 8, there is shown in cross-section C-C in FIG. 5 one of the tools 76 having tapered shoulders 86.

While the invention has been described in terms of what is presently considered to be the most practical and preferred embodiments, it is to be understood that the invention needs not be limited to the disclosed embodiment. It is intended to cover various modifications and similar arrangements included within the spirit and scope of the appended claims which are to be accorded with the broadest interpretation so as to encompass all such modifications and similar structures.

What is claimed is:

1. A hammer comprising:

a. an elongate handle defining a first axis, a first end and a second end;

b. a head having a second axis perpendicular to said first axis and a first, a second and a third striking face;

c. wherein said head is fixed to said first end of said elongate handle;

d. at least one object puffing means integral to said hammer;

e. the head comprises a striker body fixed to a neck extending forwardly along said second axis;

f. said striker body comprises said first striker face at the distal end thereof and perpendicular to the second axis; and g. the striker body comprises said second striker face depending rearward from the first striker face at a predetermined angle.

2. The hammer of claim 1 wherein the head further comprises a first object puffing tool extending rearward and generally parallel to the second axis.

3. The hammer of claim 1 wherein the head further comprises an aperture for receiving the elongate handle first end.

4. The hammer of claim 1 wherein the first striker face and the second striker face comprise a plurality of spaced hemispherical pits.

5. The hammer of claim 1 wherein said third striking face is disposed on at least one side of the head over said first axis.

6. The hammer of claim 5 wherein the third striking face comprises a circular disc.

7. The hammer of claim 1 wherein said striker body further comprises a nail alignment device comprising a nail alignment slot in the striker head and a nail head recess disposed in the neck for receiving a nail head.

8. The hammer of claim 1 wherein the elongate handle comprises a spine defining a first end and a second end, wherein said spine first end is fixed to the head, and wherein the spine is overlain by shock absorbing material.

9. The hammer of claim 8 wherein said spine second end is aperture to accept a second object pulling tool in a pivoting relationship.

10. A hammer comprising:

a. an elongate handle defining a first axis, a first end and a second end;

b. a head having a second axis perpendicular to said first axis and a first, a Second and a third striking face;

c. wherein said head is fixed to said first end of said elongate handle;

d. at least one object pulling means integral to said hammer;

e. said third striking face is disposed on at least one side of the head over said first axis;

f. the third striking face comprises a circular disc; and g. the third striking face is attached to the head by a nut and screw.

11. The hammer of claim 10 wherein a circular neoprene spacer is disposed between said circular disc and the head.

12. A hammer comprising:

a. an elongate handle defining a first axis, a first end and a second end;

b. a head having a second axis perpendicular to said first axis and a first, a second and a third striking face;

c. wherein said head is fixed to said first end of said elongate handle;

d. at least one object pulling means integral to said hammer;

e. wherein the elongate handle comprises a spine defining a first end and a second end, wherein said spine first end is fixed to the head and the spine is overlain by shock absorbing material;

f. said spine second end is aperture to accept a second object pulling tool in a pivoting relationship; and g. the handle has a forward end that is curved and a rearward end that is sharp for scraping and splitting a work piece.

* * * * *